US006905355B2

(12) United States Patent
Fukamachi

(10) Patent No.: US 6,905,355 B2
(45) Date of Patent: Jun. 14, 2005

(54) LEVER-TYPE CONNECTOR AND CONNECTOR HOUSING THEREFOR

(75) Inventor: Makoto Fukamachi, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/818,991

(22) Filed: Apr. 6, 2004

(65) Prior Publication Data

US 2005/0003690 A1 Jan. 6, 2005

(30) Foreign Application Priority Data

Jul. 4, 2003 (JP) ..... 2003-102603

(51) Int. Cl.[7] ..... H01R 13/62
(52) U.S. Cl. ..... 439/157; 439/372
(58) Field of Search ..... 439/157, 372, 439/152–156, 158–160

(56) References Cited

U.S. PATENT DOCUMENTS 5,174,785 A * 12/1992 Endo et al. ..... 439/489
5,230,635 A * 7/1993 Takenouchi et al. ..... 439/157
5,476,390 A 12/1995 Taguchi et al.
5,518,413 A * 5/1996 Taniuchi et al. ..... 439/157
5,531,605 A * 7/1996 Taniuchi et al. ..... 439/157
6,736,655 B2 * 5/2004 Martin et al. ..... 439/157
2004/0209503 A1 * 10/2004 Fukamachi ..... 439/157

* cited by examiner

*Primary Examiner*—Ross Gushi
*Assistant Examiner*—James R. Harvey
(74) *Attorney, Agent, or Firm*—Gerald E. Hespos; Anthony J. Casella

(57) ABSTRACT

A lever-type connector has two housings (10, 20) and a lever (40) with a cam for facilitating the connection of the housings (10, 20). The connector is configured so that a connection resistance between the housings (10, 20) and an operation resistance on the lever (40) reach their maximums at substantially the same time. Thus, a separate resistance generator is unnecessary, and an operator is less likely to erroneously stop the connecting operation upon an increase in the operation resistance caused by a separate resistance generator. Accordingly, the two housings (10, 20) can be connected properly with high reliability.

10 Claims, 7 Drawing Sheets

LEVER-TYPE CONNECTOR AND CONNECTOR HOUSING THEREFOR

BACKGROUND OF THE INVENTION

1. Field of the Invention

The invention relates to a lever-type connector and a housing therefor.

2. Description of the Related Art

U.S. Pat. No. 5,476,390 discloses a lever-type connector with a female housing. A lever is mounted on the female housing and is formed with a cam groove. The cam groove is engageable with a cam pin on a mating male housing. The housings are positioned initially with the lever at a connection starting position and with the cam pin facing the entrance of the cam groove. The lever then is rotated so that the cam pin moves along the cam groove to pull the housings together. The connector relies on the leverage of the lever to connect the two housings with a small force.

The above-described housings may be left partly connected if the rotation of the lever is stopped before the housings are connected properly. An inertial locking mechanism has been studied to prevent the housings from being left partly connected. The inertial locking mechanism temporarily provides a large operation resistance to the lever in the connecting process. The resistance is reduced during the rotation and the lever is rotated to the ending position in a single a stroke.

The cam groove could have a steep area to give a high operation resistance to the lever. However, the increase of the maximum operation resistance on the lever could cause an operator to infer incorrectly that the connection is complete. Thus, the operator may stop the connecting operation prematurely, and the connector may be left partly connected.

The invention was developed in view of the above problem and an object thereof is to ensure that two housings can be connected properly with high reliability.

SUMMARY OF THE INVENTION

The invention relates to a lever-type connector with first and second housings that are connectable with each other. A lever is mounted rotatably on the first housing and is formed with a cam means. A mating cam means is provided on the second housing and is engageable with the cam means to display a cam action. The lever is positioned first at a connection starting position so that the cam means engages the mating cam means. An operable portion of the lever is moved away from center axes of the two housings along a connecting direction to an upright position and then is moved towards the center axes of the two housings along a connecting direction and towards an opposite side to bring the lever to a connection ending position for connecting the housings properly. A peak where a connection resistance between the housings and/or an operation resistance on the lever both are at their maximums is set to be reached while the lever is rotated from the upright position towards the connection ending position. Thus, the operation resistance is reduced when the lever is rotated beyond the peak.

The lever can be operated beyond the peak position and to the connection ending position at a single stroke by the pushing force exerted on the operable portion of the lever at the peak. The connection resistance between the housings and the operation resistance on the lever are at their maximums at or near the peak. Thus, resistance means for creating an additional inertial force is unnecessary and the maximum value of the operation resistance is lower in absolute value. Therefore, an operator is less likely to stop the connecting operation erroneously due to an increased operation resistance, and the housings can be connected properly with high reliability.

The cam means on the lever may be a cam groove, and the mating cam means may be a cam pin.

A resilient contact piece of a female terminal fitting mounted in the female housing preferably is deformed resiliently by contact with a tab of a male terminal fitting mounted in the male housing. Thus, the female and male terminal fittings are connected electrically, and the operation resistance on the lever is set to reach its maximum when the tab resiliently deforms the resilient contact piece preferably to a maximum extent. Thus, it is unnecessary to provide additional resistance means to create an inertial force.

A resilient seal preferably is provided on at least one of the housings to provide sealing when the housings are connected properly. The operation resistance acting on the lever preferably is set to reach its maximum when the resilient seal member is being deformed.

A locking means preferably is provided for locking the lever when the lever is displaced to the connection ending position, and the cam means preferably is provided with a play area for permitting rotation of the lever without advancing the connection of the two housings substantially immediately before or near where the lever reaches the connection ending position. Accordingly, the mating cam means enters the play area immediately before the lever reaches the connection ending position and the connection resistance between the housings preferably is reduced substantially to zero. Thus, the lever can be rotated to the connection ending position and locked at with a single stroke while the force of the lever is maintained.

A start locking means preferably is provided for locking the lever at the connection starting position. A start unlocking means also may be provided for disengaging the start locking means, thereby allowing the lever to rotate in the process of connecting the housings.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A lever-type connector according to the invention is illustrated in FIGS. 1 to 8 and includes a male housing 10, a female housing 20, and a lever 40 to be mounted on the female housing 20. In the following description, connecting sides of the housings 10, 20 are referred to as the front side.

Figure 1:
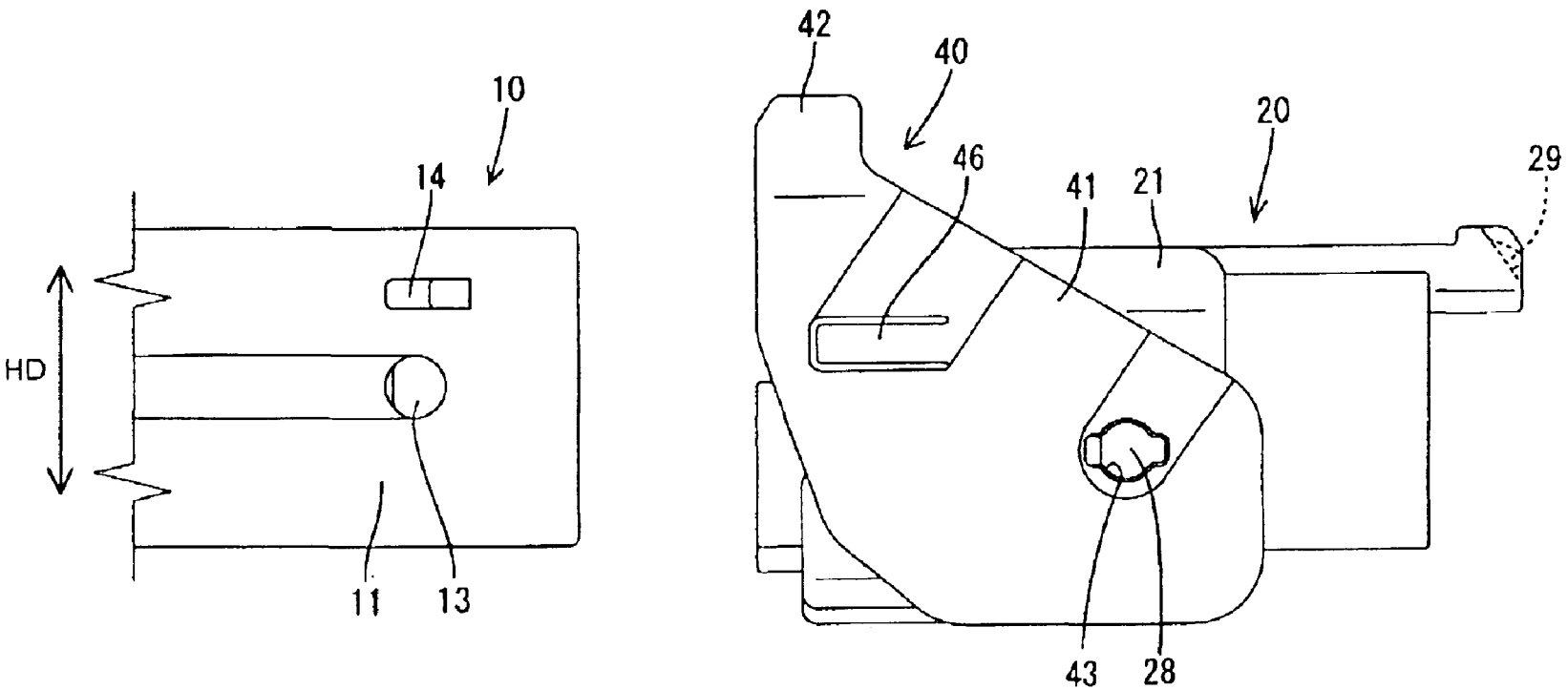
FIG. 1 is a side view of male and female housings before connection.
Figure 2:
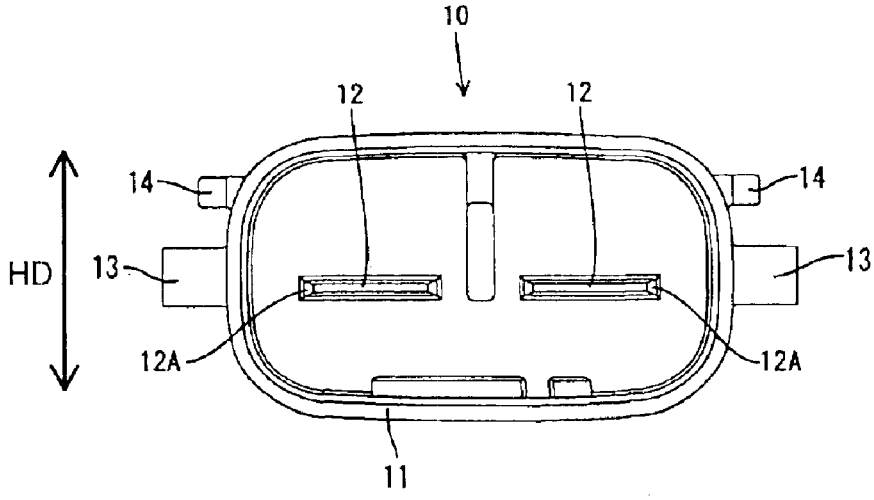
FIG. 2 is a front view of the male housing.

The male housing 10 is made e.g. of a synthetic resin, and is formed unitarily with an unillustrated device. A substantially rectangular tubular fitting 11 projects forward from the male housing 10, as shown in FIGS. 1 and 2. Two tabs 12 of male terminal fittings project substantially side by side from the back end wall of the tubular fitting 11. Each tab 12 is a substantially flat plate and has a tapered leading end 12A. A substantially cylindrical cam pin 13 projects from each of the left and right outer surfaces of the tubular fitting 11 at a position slightly toward the front end in the middle with respect to the height direction HD. An unlocking projection 14 projects above each cam pin 13.

Figure 3:
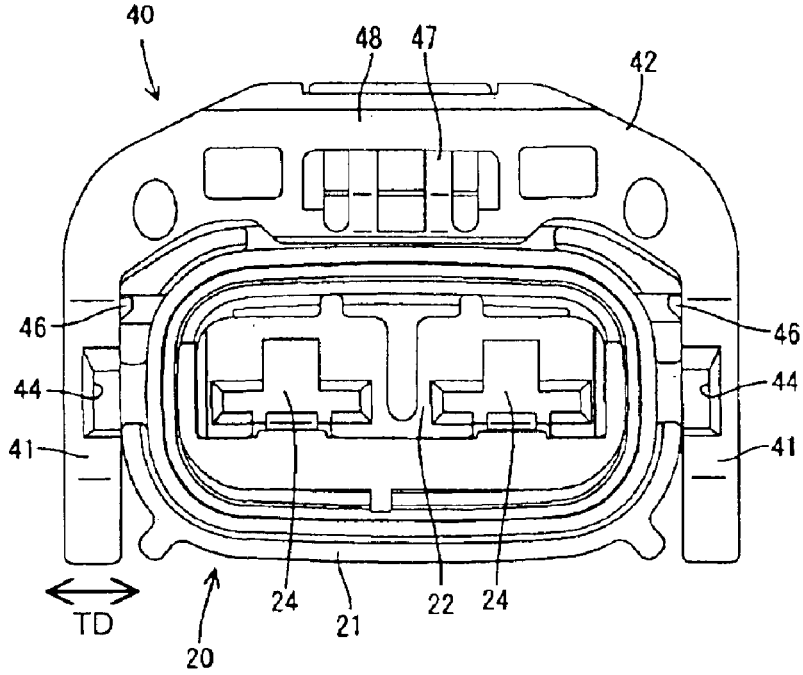
FIG. 3 is a front view of the female housing.
Figure 4:
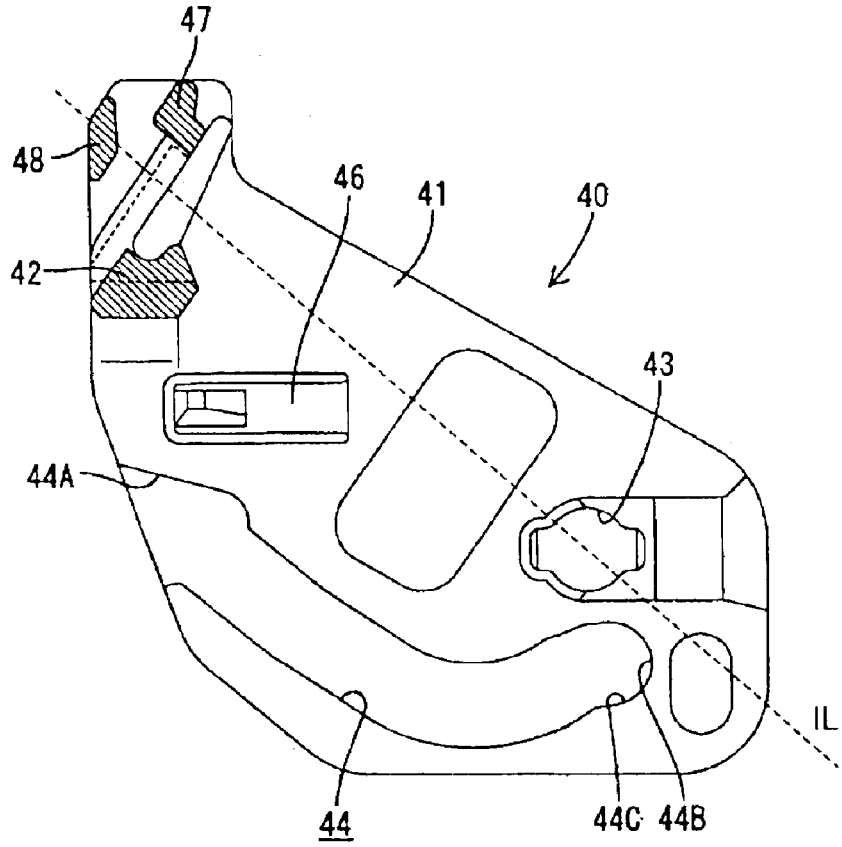
FIG. 4 is a section of a lever.
Figure 5:
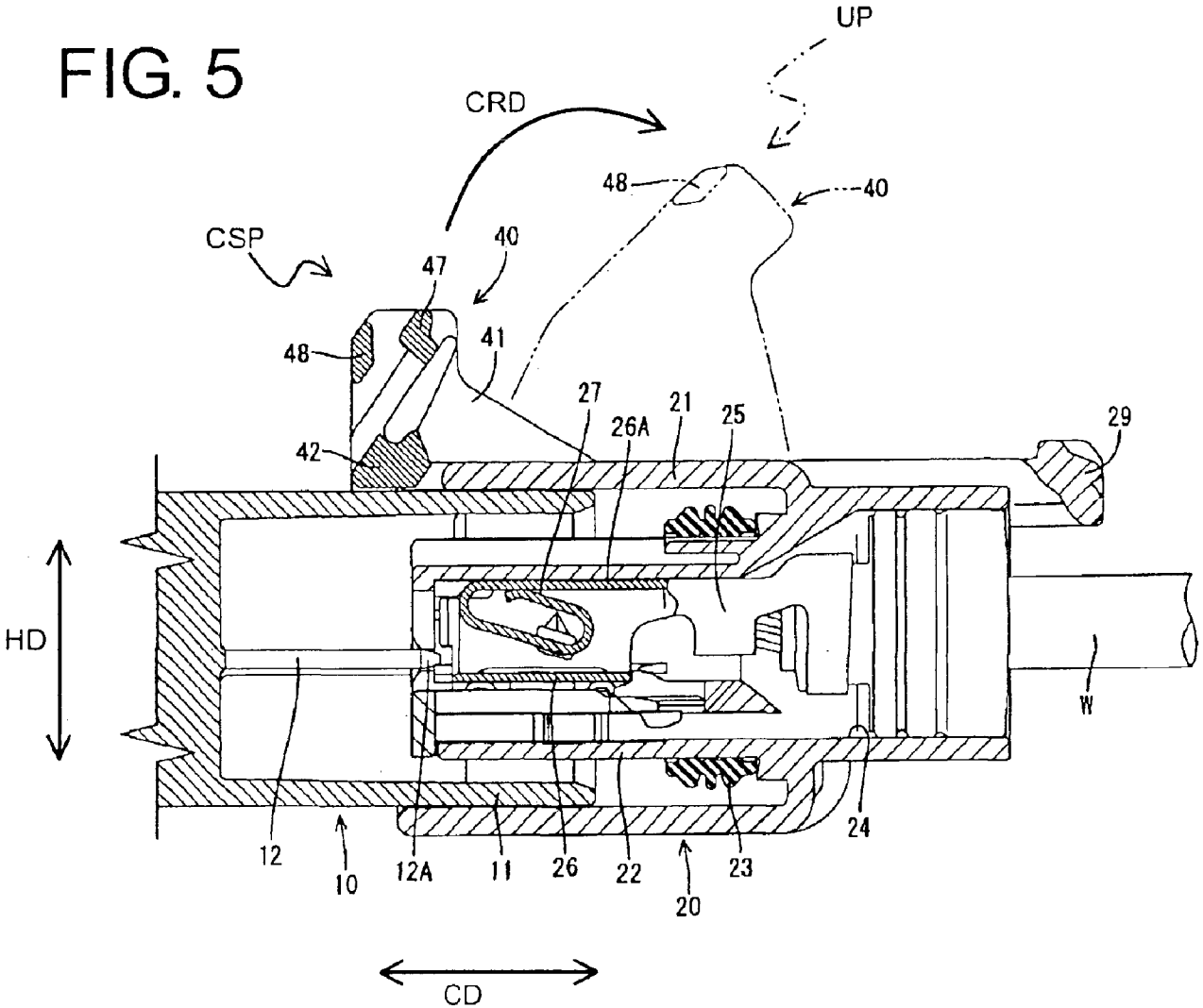
FIG. 5 is a section showing an initial state of the connection.

The female housing 20 also is made e.g. of a synthetic resin, and a receptacle 21 projects from the front surface of the female housing 20 for receiving the tubular fitting 11 of the male housing 10. A tower 22 is formed inside the receptacle 21 and is dimensioned to fit in the tubular fitting 11, as shown in FIGS. 3 and 5. A seal ring 23 is mounted on the rear end of the outer peripheral surface of the tower 22 so that the outer peripheral surface of the seal ring 23 closely contacts the inner peripheral surface of the tubular fitting 11 to close the inside of the connector in a watertight manner when the housings 10, 20 are connected properly. Left and right cavities 24 extend from the front end of the tower 22 to the rear end of the female housing 20. Female terminal fittings 25 are connected with ends of wires W and are inserted into the respective cavities 24 from behind. A rectangular terminal connecting portion 26 is formed at the front end of the female terminal fitting 25, and a resilient contact piece 27 is folded back and in from the front edge of an upper wall 26A of the terminal-connecting portion 26. The resilient contact piece 27 extends substantially straight in a direction obliquely down to the back from the upper wall 26A. The resilient contact piece 27 then is folded at an intermediate position to extend obliquely up and out. The projecting end of the resilient contact piece 27 is bent forward for contacting the upper wall 26A. The tab 12 of the corresponding male terminal fitting can be inserted into the terminal connecting portion 26 from the front so that a bottommost portion of the resilient contact piece 27 resiliently contacts the tab 12 to electrically connect the male and female terminal fittings 12, 25.

Figure 7:
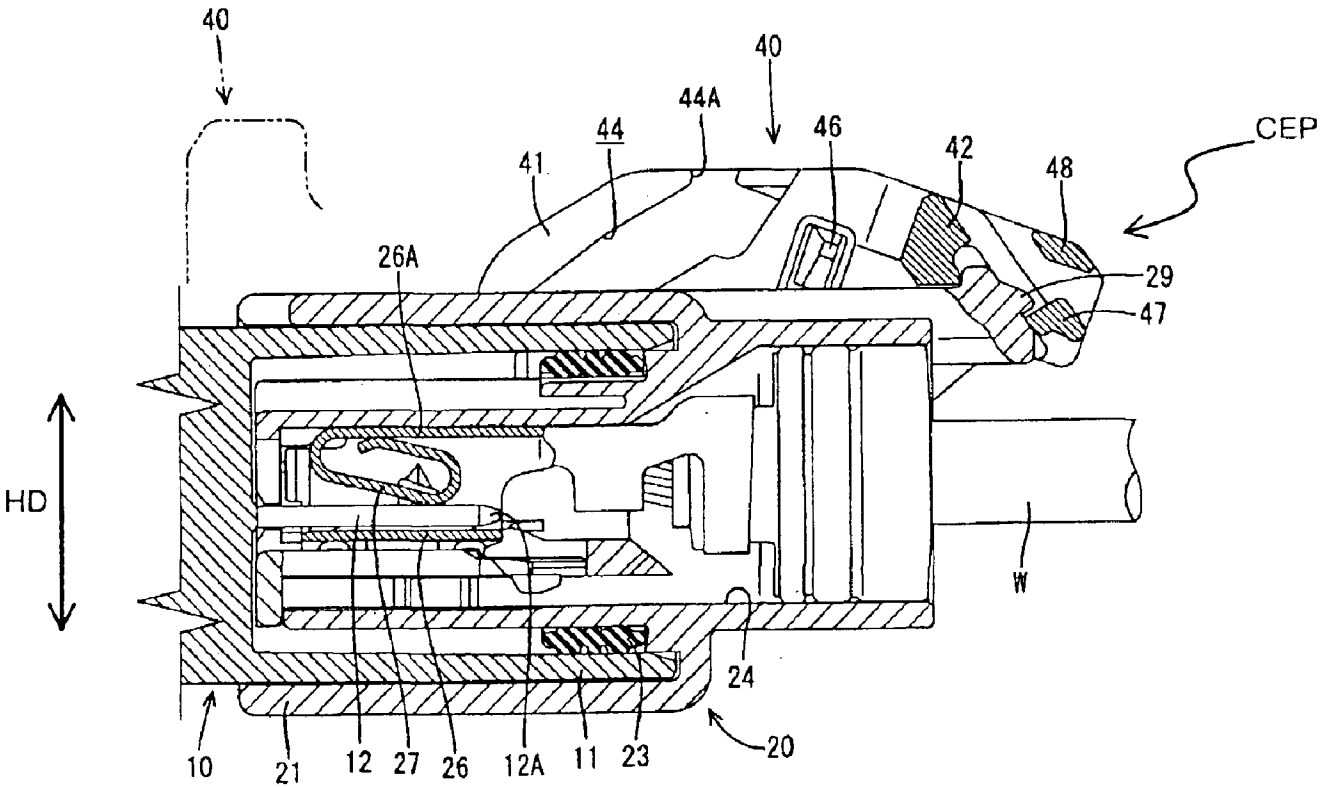
FIG. 7 is a section showing a properly connected state of the male and female connector housings.

The lever 40 is made e.g. of a synthetic resin and has left and right arms 41 joined by a coupling 42 to define a substantially U-shape. The arms 41 are mounted to the female housing 20 to hold the opposite left and right sides of the receptacle 21. Leading ends of the arms 41 have shaft-bearing recesses 43 that are supported rotatably on shafts 28 that project from the left and right outer surfaces of the receptacle 21. A cam groove 44 is formed in the inner surface of each arm 41 and is engageable with the corresponding cam pin 13 of the male connector housing 10 (see FIG. 4). Each cam groove 44 has an entrance 44A, a terminus 44B and an arcuate play area 44B at an intermediate position near the terminus 44B. A section of the cam groove 44 from the entrance 44A to the arcuate play area 44C gradually approaches the shaft bearing recess 43. However, the distance from the cam groove 44 to the shaft bearing recess 43 remains substantially constant through the arcuate play area 44C. The entrances 44A of the cam grooves 44 face forward on the female housing 20 (see FIG. 5) at a connection starting position CSP. The housings 10, 20 are positioned so that the cam pins 13 enter the cam grooves 44. The lever 40 then is rotated in a connection rotation direction CRD (clockwise direction of FIG. 5) and the cam pins 13 are displaced along the cam grooves 44 to assist the connection of the housings 10, 20. The lever 40 is rotated without advancing the connection of the two housings 10, 20 when the cam pins 13 enter the play areas 44C. The two housings 10, 20 are connected properly when the cam pins 13 reach connection ending positions CED located at the termini 44B of the cam grooves 44, as shown in FIG. 7.

A locking piece 46 is formed on each arm 41 near the coupling 42 and is resiliently deformable substantially along a thickness direction TD of each arm 41 (FIG. 3). The locking pieces 46 substantially engage the front end of the receptacle 21 when the lever 40 is at the connection starting position CSP (see FIGS. 3 and 5). An operable portion 48 is provided in the middle of the front surface of the coupling 42 for receiving fingers to rotate the lever 40. The arms 41 extend along the side surfaces of the housing 20 when the lever 40 is in the connection starting position CSP and the operable member 48 contacts a portion of the housing 20. The unlocking projections 14 of the male housing 10 resiliently deform the locking pieces 46 out to disengage the locking pieces 46 from the receptacle 21 during connection of the housings 10, 20, thereby allowing the lever 40 to rotate.

A resiliently deformable lock arm 47 is cantilevered from a substantially a middle part of the coupling 42. On the other hand, a lock projection 29 extends back from the middle of the upper surface of the female housing 20. The lock arm 47 engages the lock projection 29 when the lever 40 reaches the connection ending position CED. Thus, the lever 40 is held so as not to rotate and the housings 10, 20 are held connected with each other. The arms 41 are reclined along the side surfaces of the housing 20 when the lever 40 is in the connection ending position CEP, but extend in a direction substantially opposite the direction that exists in the connection starting position CSP. Thus, the operable member 48 contacts a substantially opposite portion of the housing 20.

The lever 40 initially is held at the connection starting position CSP with respect to the female housing 20. The tubular fitting 11 of the male housing 10 then is fit lightly into the receptacle 21 of the female housing 20 as shown in FIG. 5. Thus, the cam pins 13 enter the entrances 44A of the cam grooves 44. In this process, the unlocking projections 14 contact the locking pieces 46 of the lever 40 and resiliently deform the locking pieces 46 out in a disengagement direction sufficiently to disengage the locking pieces 46 from the female housing 20. In this way, the lever 40 at the connection starting position CSP is released from its rotation-movement-prevented state.

Fingers then are placed on the operable portion 48 of the lever 40 to move the operable portion 48 obliquely up and away from the housings 10, 20. Thus, the operable portion 48 is moved away from center axes of the two housings 10, 20 along a connecting direction CD (transverse direction of FIG. 5), thereby rotating the lever 40 in the connection rotation direction CRD (clockwise in FIG. 5). As a result, the housings 10, 20 are pulled toward each other along the connection direction CD and gradually are connected with each other by a cam action between the cam pins 13 and the cam grooves 44. The tapered leading ends 12A of the tabs 12 enter the terminal connecting portions 26 of the female terminal fittings 25 and contact the resilient contact pieces 27. The tapered leading ends 12A of the tabs 12 gradually push the resilient contact pieces 27 up and out as the two housings 10, 20 are connected further, thereby resiliently deforming the resilient contact pieces 27. The operable portion 48 eventually reaches an upright position UP (shown in phantom in FIG. 5) where an imaginary line IL (FIG. 4) passing through the operable portion 48 and the shaft bearing recesses 43 is substantially perpendicular to the connecting direction CD and where the operable portion 48 is most distanced from the center axes of the two housings 10, 20 along the connecting direction CD (transverse direction of FIG. 5). The lever 40 then is rotated further in the connection rotation direction CRD by pushing the operable portion 48 down towards the opposite side.

Figure 6:
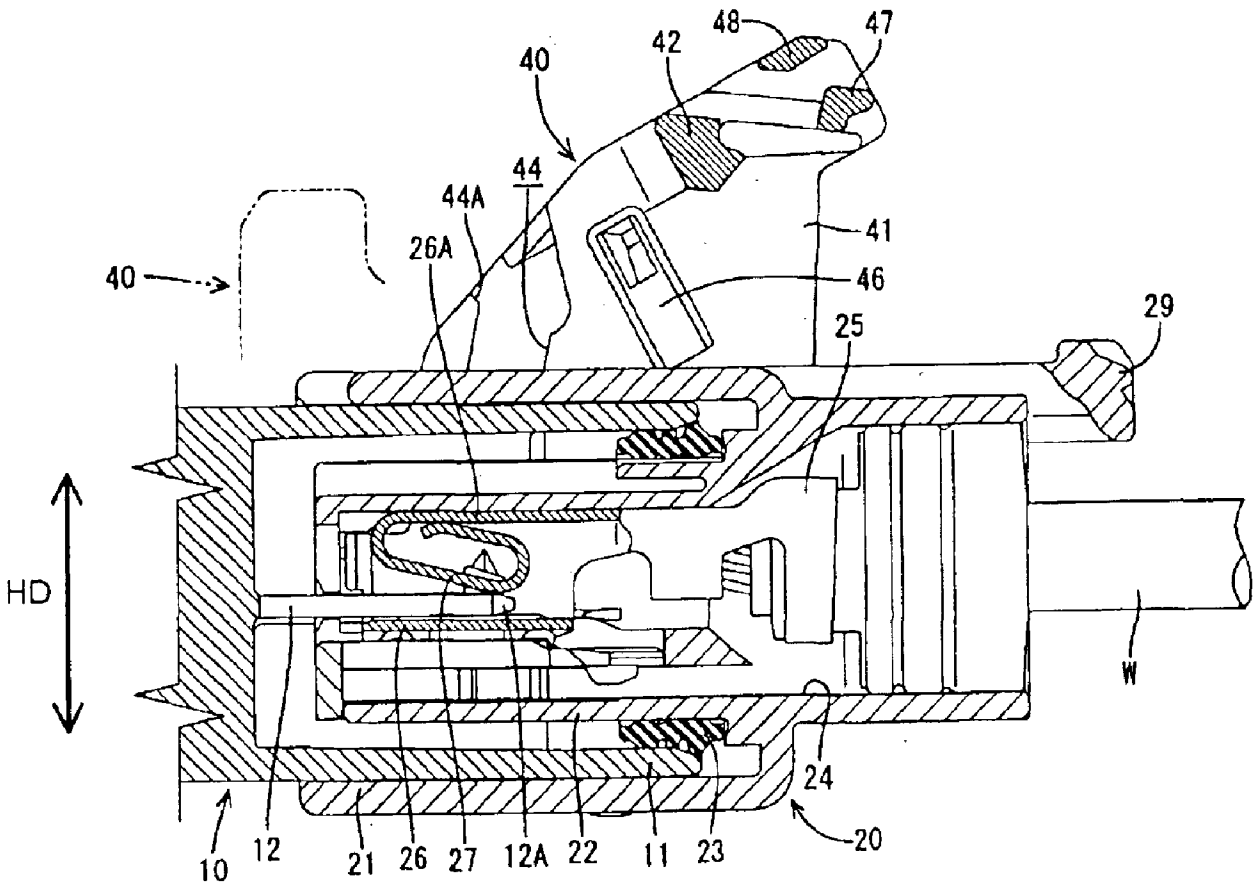
FIG. 6 is a section showing a state where an operation resistance reaches a peak.
Figure 8:
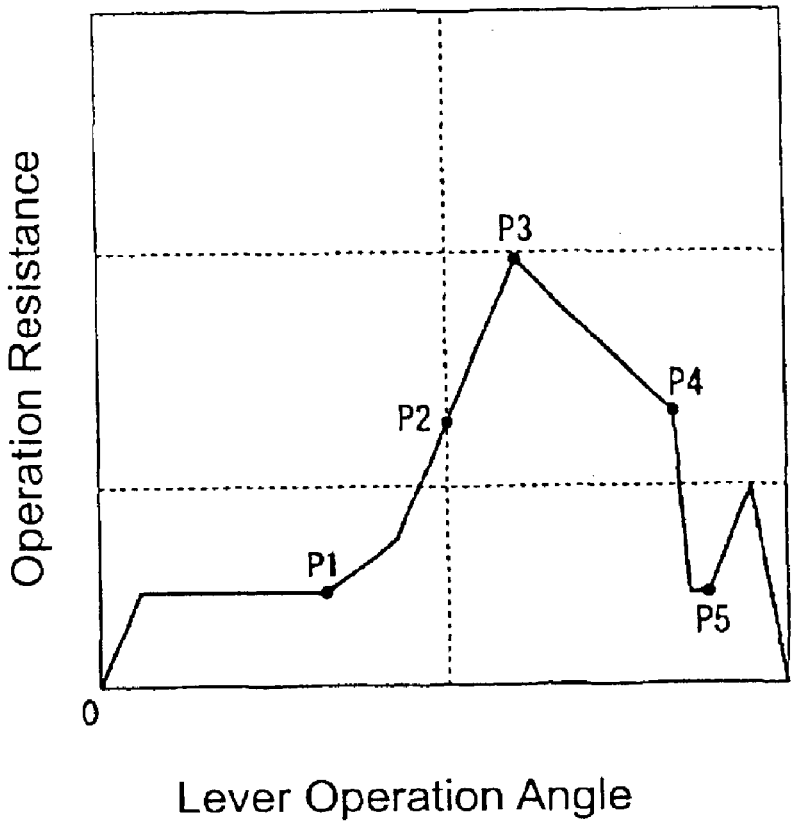
FIG. 8 is a graph showing the operation resistance in relation to a lever operation angle.

In this connecting process, an operation resistance resulting from a connection resistance between the two housings 10, 20 acts on the lever 40 as shown in FIG. 8. This operation resistance gradually increases as the resilient contact pieces 27 are deformed to a larger extent after the tapered leading ends 12A of the tabs 12 contact the resilient contact pieces 27 (P1) as shown in FIG. 8. The resilient contact pieces 27 pass the tapered leading ends 12A of the tabs 12 and deform to a maximum extent when the lever 40 is rotated beyond the upright position UP (P2), as shown in FIG. 6. At this time, a peak (P3) is reached where the connection resistance acting between the two housings 10, 20 (e.g. also due to the compression of the seal ring 23 between the two housings 10, 20) and the operation resistance acting on the lever 40 is at its maximum.

At this point, a force exceeding the operation resistance at the peak (P3) is exerted on the operable portion 48 to rotate the lever 40 further. The connection resistance acting between the two housings 10, 20 then is reduced because the degree of deformation of the resilient contact pieces 27 does not change from this time on. Accordingly, the operation resistance on the lever 40 is reduced. Therefore, the lever 40 is rotated in a single stroke by the pushing force exerted at the peak (P3). As a result, the two housings 10, 20 are connected to a proper depth in a single stroke (P4).

The cam pins 13 enter the play areas 44C of the cam grooves 44 when the lever 40 is rotated from this state (P4). Thus, the lever 40 is idly rotatable and the connection resistance between the housings 10, 20 becomes zero. The operable portion 48 of the lever 40 is rotated with an ongoing force due to the sudden reduction in the operation resistance on the lever 40. The leading end of the lock arm 47 then contacts the lock projection 29 (P5) and deforms sufficiently to move onto the upper surface of the lock projection 29. The lock arm 47 then moves over the lock projection 29 and is restored resiliently to engage the lock projection 29. In this way, the lever 40 is locked at the connection ending position CED and the two housings 10, 20 are locked in their properly connected state.

As described above, the lever 40 is pushed to the connection ending position CED in a single stroke by the pushing force exerted on the operable portion 48 at the peak (P3) of the operation resistance. The connection resistance acting between the housings 10, 20 and the operation resistance acting on the lever 40 are set to be at their maximums at the peak (P3). Thus, it is not necessary to provide separate resistance means for creating an inertial force and accordingly the maximum value of the operation resistance can be lower. Therefore, an operator is less likely to stop the connecting operation erroneously due to an increase in the operation resistance, and the two housings 10, 20 can be connected properly with high reliability.

The peak (P3) is reached when the tabs 12 resiliently deform the resilient contact pieces 27 to the maximum extent. Thus, it is not necessary to provide additional resistance means for creating an inertial force.

The cam pins 13 enter the play areas 44C of the cam grooves 44 to reduce the connection resistance between the two housings 10, 20 to zero immediately before the lever 40 reaches the connection ending position CED to be locked. Thus, the lever 40 can be rotated to the connection ending position CED (FIG. 7) and locked in a single stroke while the ongoing force of the lever 40 is maintained.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

Although the lever is mounted on the female housing in the foregoing embodiment, it may be mounted on the male housing.

The means for locking the lever at the connection ending position CED may be provided between the lever and the mating housing to be connected with the housing on which the lever is directly mounted.

Although the movable member is described to be a rotatable lever in the above-described embodiment, it should be understood that the invention is applicable to any other movable member such as a substantially linearly or arcuately movable member having a suitable cam means engageable with mating cam means provided on the corresponding housing.

What is claimed is:

1. A lever-type connector, comprising:

first and second housings connectable with each other, a lever rotatably mounted on the first housing and formed with a cam means, a mating cam means provided on the second housing and engageable with the cam means to display a cam action, wherein:

the lever is positioned initially at a connection starting position for engaging the mating cam means with the cam means, the lever having an operable portion that is movable away from center axes of the two housings along a connecting direction to an upright position and then is movable substantially towards the center axes of the two housings along a connecting direction to an opposite side to bring the lever to a connection ending position, thereby properly connecting the two housings, and a peak being defined where a connection resistance between the two housings and an operation resistance on the lever both are set to reach maximum values while the lever is rotated from the upright position to the connection ending position, so that the operation resistance is reduced when the lever is rotated beyond the peak.

2. The lever-type connector of claim 1, further comprising a tab in the second housing for contacting and resiliently deforming a resilient contact piece in the first housing, the operation resistance on the lever being set to reach its maximum when the tab resiliently deforms the resilient contact piece.

3. The lever-type connector of claim 2, wherein the operation resistance on the lever is set to reach its maximum when the tab resiliently deforms the resilient contact piece to a maximum extent.

4. The lever-type connector of claim 1, wherein a resilient seal is provided on at least the first housing to provide a sealing function at least when the housings are connected properly.

5. The lever-type connector of claim 4, wherein the operation resistance acting on the lever is set to reach its maximum when the resilient seal is being deformed.

6. The lever-type connector of claim 1, further comprising a lock for locking the lever when the lever is displaced to the connection ending position.

7. The lever-type connector of claim 1, wherein the cam means has a play area for permitting rotation of the lever without advancing the connection of the two housings substantially immediately before where the lever reaches the connection ending position.

8. The lever-type connector of claim 1, wherein a start locking means is provided for locking the lever substantially at the connection starting position.

9. The lever-type connector of claim 8, wherein a start unlocking means is provided for disengaging the start locking means, thereby allowing the lever to rotate for connecting the two housings.

10. A housing for a lever-type connector connectable with a mating housing, a lever rotatably mounted on the housing and formed with a cam means for engaging a mating cam means on the mating housing to display a cam action, wherein:

the lever is positioned initially at a connection starting position with the cam means aligned for engaging the mating cam means, at least a portion of the lever being movable substantially away from center axes of the two housings along a connecting direction to an upright position and then being movable substantially towards the center axes of the two housings along a connecting direction to an opposite side to bring the lever to a connection ending position, thereby substantially properly connecting the two housings, and a peak where a connection resistance acting between the two housings and an operation resistance acting on the lever are both at their maximums while the lever is rotated from the upright position towards or to the connection ending position, so that the operation resistance is reduced when the lever is rotated beyond the peak.

* * * * *